United States Patent [19]

Juntwait

[11] Patent Number: 4,826,446

[45] Date of Patent: May 2, 1989

[54] ELECTRICAL CONTACT PINS AND ASSEMBLIES

[75] Inventor: Eric Juntwait, Norwalk, Conn.

[73] Assignee: Burndy Corporation, Norwalk, Conn.

[21] Appl. No.: 190,025

[22] Filed: May 4, 1988

[51] Int. Cl.[4] ..... H01R 23/70; H01R 9/09; H01R 13/41

[52] U.S. Cl. ..... 439/326; 439/328; 439/341; 439/636

[58] Field of Search ..... 439/326-328, 439/341, 69, 71, 73, 629, 630, 636

[56] References Cited

U.S. PATENT DOCUMENTS 3,848,952 11/1974 Tighe, Jr. ..... 439/326
4,136,917 1/1979 Then et al. ..... 439/326
4,713,013 12/1987 Regnier et al. ..... 439/326 X
4,737,120 4/1988 Grabbe et al. ..... 439/326

*Primary Examiner*—Joseph H. McGlynn
*Assistant Examiner*—Steven C. Bishop
*Attorney, Agent, or Firm*—Perman & Green

[57] ABSTRACT

Electrical connector assemblies comprising a housing and a plurality of contact pins engaged therein, the pins having spaced flexible contact arms adapted to receive and be flexed apart by an electrical component such as a printed circuit card during the pivot attachment thereof. The contact pins have a spaced pair of lower contact legs and a spaced pair of upper contact arms, one of which is generally C-shaped and flexible in directions towards and away from the other to provide a flexible gap therebetween which, at rest, is greater than the thickness of the printed circuit card.

4 Claims, 4 Drawing Sheets

ELECTRICAL CONTACT PINS AND ASSEMBLIES

BACKGROUND OF THE INVENTION

The present invention relates to contact pins and to multi-contact linear electrical connector assemblies or microedge connectors for thin printed circuit cards carrying surface-mounted chips having closely-spaced circuit contact pads to be placed into electrical contact with the corresponding closely-spaced contact pins of the connector assemblies.

Reference is made to U.S. Pat. No. 4,665,614 for its disclosure of electrical contact pins and multiple-contact electric connector assemblies containing such pins and the cooperative engagement and use of such assemblies with thin printed circuit cards of the types for which the present assemblies and electrical contacts are designed. Such assemblies, sometimes referred to as sockets, are designed to receive standard leadless printed circuit cards or modules upon which a number of memory chips are mounted, the chips being connected to electrical contact pads on opposite sides of the card along a contact edge thereof. Such reception involves inserting the contact edge of the card or module within the linear gap formed between pairs of spaced flexible contact legs of a plurality of aligned electrical contact pins supported by an insulation housing. Little or no contact with the pins is made during insertion of the card edge, but the card is then pivoted and locked into place, either vertically or at an angle, during which pivot movement the card engages and flexes the contact legs apart to stress or load the contact leg pairs of the aligned contacts against the spaced contact pads on the circuit card to provide the desired multiple circuit connections.

In conventional sockets or microedge housings, the circuit card is locked into engaged position by opposed small tapered tab members, present on flexible fingers. Insertion of the circuit card forces the side edges of the card over the taper of the opposed tabs and flexing of the fingers until the side edges of the card pass under the small tabs causing the fingers to snap out and engage the side edges of the card and causing the tabs to overlie a small portion of the top surface at each side edge of the card to lock the card in position. Such engagement is restricted to the extreme side edges of the card and is subject to failure if either the side edges of the card or the small tabs are irregular or break. Also such extreme side edge attachment causes greater bowing of the circuit card than is desirable, which bowing is in a direction which can result in slip-release of the engagement.

Microedge connectors are designed with contact housings in pre-determined sizes, shapes and configurations to accommodate different standard printed circuit cards in either vertical or tilted angular alignment. Generally such cards have circuit pads spaced by 0.05 inch, center to center, with a plurality of pads depending upon the number of circuits present, i.e., 30, 42, 72, etc. Thus, the elongate, insulating contact pin housings have a length and a pin capacity and spacing to accommodate the desired printed circuit cards, i.e., means for mounting the desired number of contact pins in side-by-side alignment, center-spaced by 0.05 inch, the pins being up to about 0.035 inch in thickness or width in order to provide adequate spacing therebetween under conditions of use.

Since flexible connector pins of the types used in multi-contact, microedge connectors are small, delicate and subjected to flexing during each insertion and removal of a printed circuit card, such pins are susceptible to distortion and/or breakage if the flexible contact legs thereof are bent or deflected in the wrong direction during linear insertion of the card edge, or if the legs are flexed open to an excessive extent during pivot-attachment of the card. These problems are reduced by providing an adequate insertion gap or space between the contact legs to permit insertion of the card edge with little or no contact with either of the legs, i.e., no insertion force required. However, the design of the connector pins must be such that the contact legs engage the circuit card contact zones with sufficient force when the card is pivoted or snapped into final position to provide satisfactory electrical conduction under the conditions of use.

Also, in cases where overstress or over-flexing of the contact pins is prevented by a portion of the pin engaging another portion of the pin, i.e., a shoulder portion or adjacent areas of the opening of a flexible loop portion, the structure of the pins and the housing is difficult to produce and to assemble, and/or the restraining force is dependent upon straight engagement between portions of the thin pins which generally have a thickness of between 0.005 and 0.025 inch. Such metal-to-metal contact can result in over-ride slippage, jamming, wear and/or warping and failure of the intended overstress prevention results.

SUMMARY OF THE INVENTION

The present invention relates to improved flexible connector pins and to sockets or microedge connector assemblies containing such pins and designed to receive thin printed circuit cards for pivot attachment thereto, such assemblies comprising multipin housings having such pins frictionally-engaged and cooperatively supported within individual pin-receiving slots in a manner which provides free or zero force insertion access to the card edge, satisfactory contact force when the card is rotated and snapped into attachment, flexing of the contact pin arms to produce increased engagement force between the contact pins and the seated circuit board, and strong, releasable opposed socket fingers which snap over the top surface at the side ends of an engaged circuit board to maintain the board in engaged position without any engagement with or pressure against the side edges of the card.

The advantages of the present invention are produced by designing the flexible connector pins and their housing so that they lock together and cooperate with each other to share and distribute the stresses exerted during use, whereby connector pins of less complex structure and assemblies of smaller profile can be used to provide free card access, rapid attachment force during card rotation, small attachment arc, increased engagement force, and/or overstress prevention.

THE DRAWINGS

Figure 1:
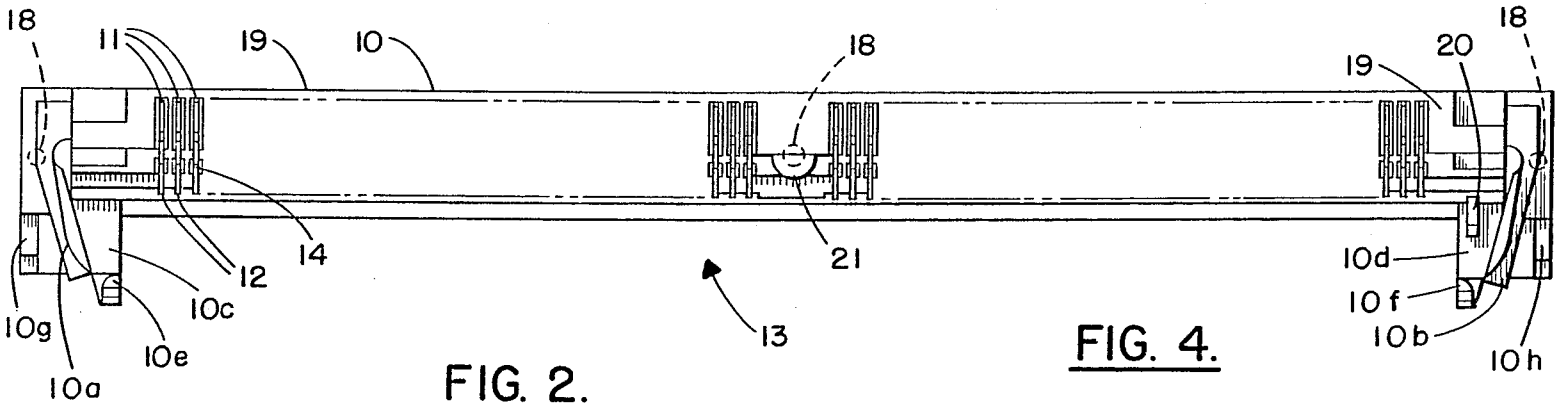
FIG. 1 is a plan view of an angle socket housing according to one embodiment of the present invention.
Figure 2:
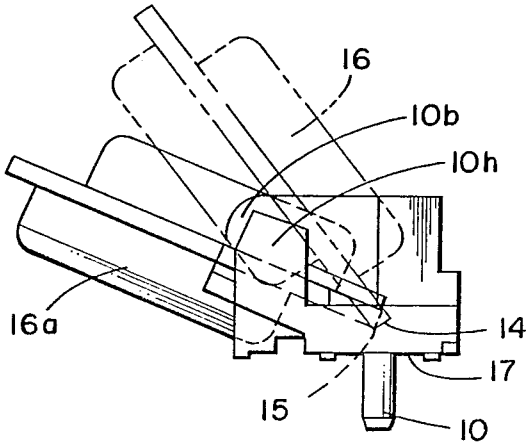
FIG. 2 is an end view of the angle socket housing of FIG. 1, illustrating the insertion and connected positions of a printed circuit card by means of broken lines.
Figure 3:
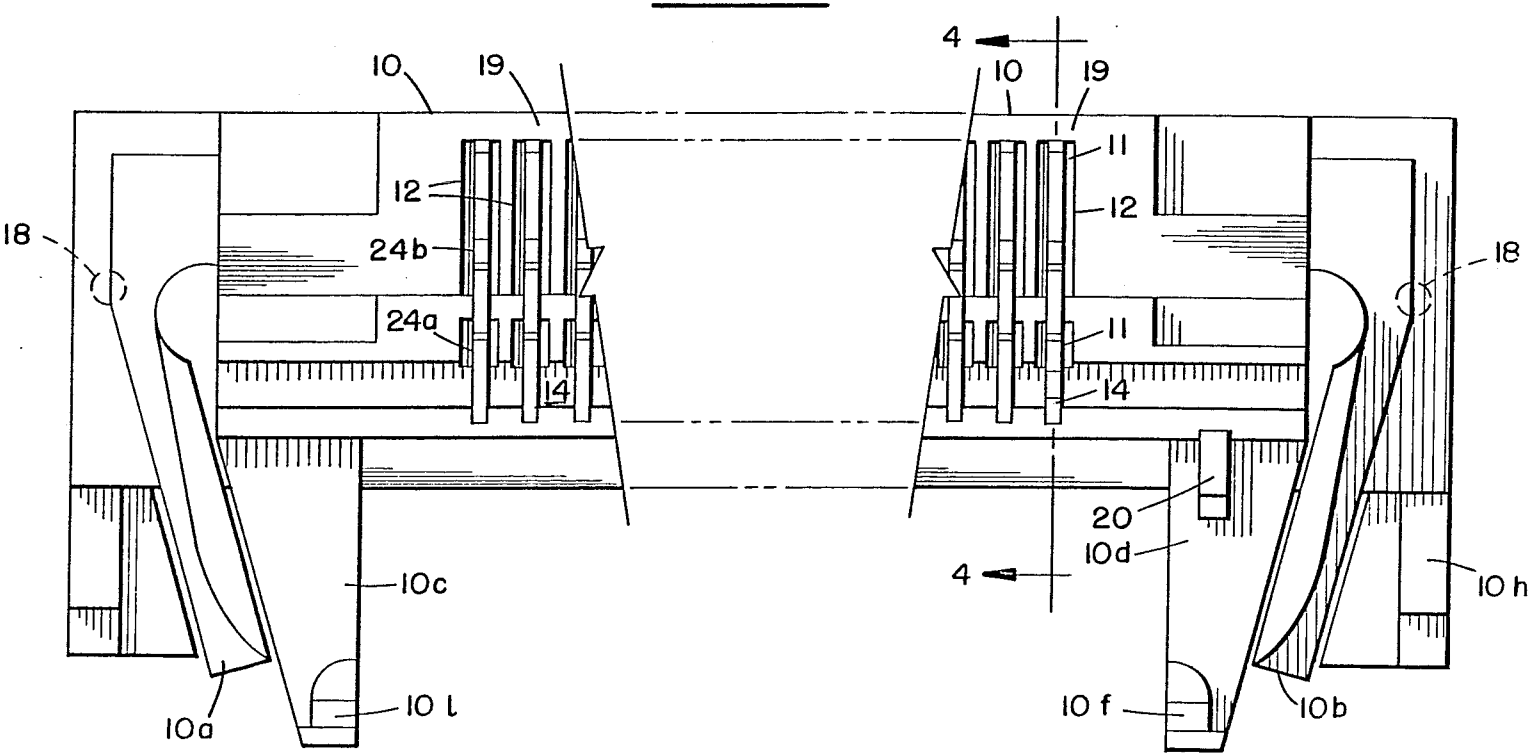
FIG. 3 is an enlarged view of a portion of the angle socket housing of FIG. 1.
Figure 7:
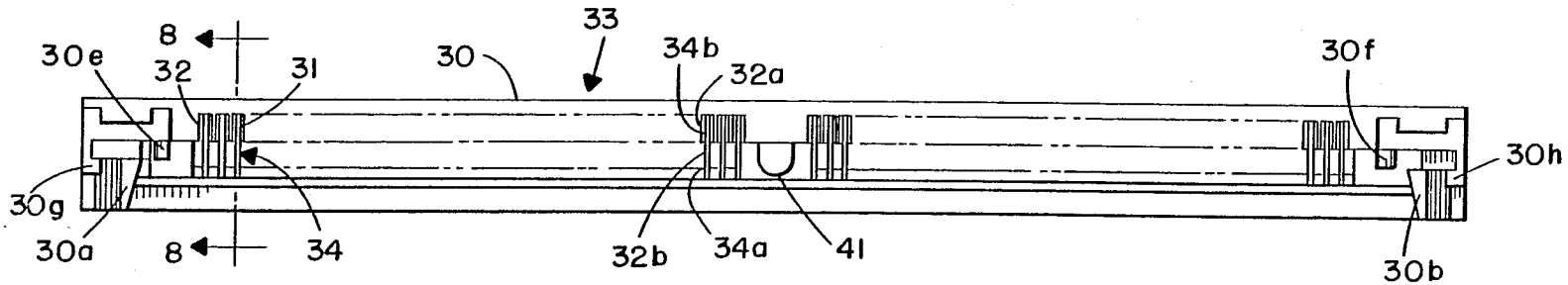
FIG. 7 is a plan view of the vertical socket housing of FIG. 6.

DISCUSSION OF THE DRAWINGS FIGS. 1 to 4 of the present drawings illustrate an angle socket housing 10 and flat contact pins 11 designed to be frictionally-engaged within each of the plurality of parallel pin slots 12 thereof to provide a multi-pin connector assembly 13 having an elongate slot 14 for receiving the thin edge 15 of a printed circuit card 16 for pivot attachment in angular or inclined position, as shown in FIG. 2.

Referring to FIG. 1, the angle socket housing 10 thereof is an elongate plastic body molded from a high dielectric, strong, heat-resistant plastic molding composition, so as to have a standoff undersurface 17 provided with three alignment mounting posts 18, one adjacent each end and one in the center, which are positioned for engagement within holes in a mother printed circuit board, not shown, to receive and support the present pin connector assembly 13 for solder attachment thereto.

The housing 10 has an upper surface 19 provided with an elongate longitudinal recess or slot 14 having a polarizing rib 20 adjacent one end thereof and central rounded alignment stud 21 which mates with a recess (not shown) in the center of the edge 15 of the printed circuit card 16 to control the insertion and seating position of the card. The upper surface 19 of the housing 10 is also provided with a plurality of parallel contact pin-receiving slots 12 which extend through and perpendicular to the longitudinal recess or slot 14. The slots 12 are clustered in two groups, one group at each side of the central alignment stud 21, the slots 12 in each group being uniformly spaced from each other, center-to-center, by a predetermined distance such as 0.05 inch, and each slot 12 having a uniform predetermined width, such as 0.015 inch, to receive a contact pin 11 of predetermined thickness, such as 0.0126 inch, therewithin, each slot 12 providing a walled recess which receives a contact pin 11 in a manner which permits the pin to flex freely within its own plane but which confines and insulates the pin against movement in the direction of adjacent contact pins 12.

Figure 4:
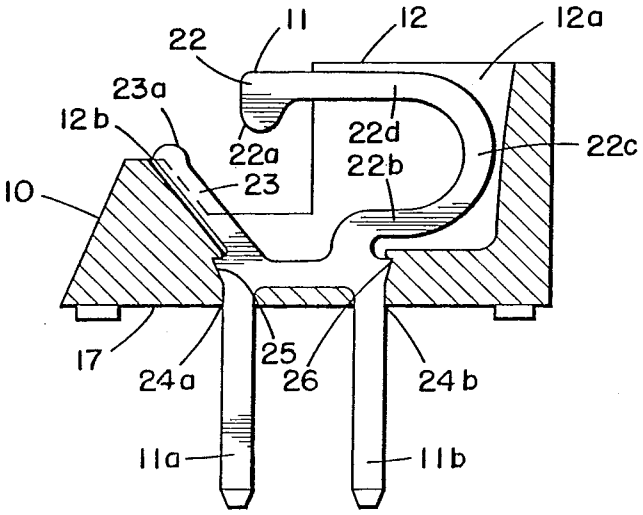
FIG. 4 is a view taken along the line 4—4 of FIG. 3 and illustrating the presence of an angle contact pin within one of the pin slots thereof.

As shown more clearly in FIG. 4, the pin-receiving slots 12 confine a substantial portion of the contact pins 11, including the upper horizontal-extending portion 22*d* of flexible arm 22 which is confined within a deep portion 12*a* of the slots 12, and the lower, angular flexible arm 23, which is confined within a more shallow portion 12*b* of the slots 12. The housing undersurface 17 is also provided with a plurality of spaced pairs of contact leg openings 24*a* and 24*b*, one pair located within each of the contact slots 12 and of such size and location to receive the contact legs 11*a* and 11*b* of a contact pin 11 seated within each of the slots 12. Alternate contact legs 11*a* and 11*b* of adjacent contact pins 11 are cut away just below the floor 17 of the housing 10 so that only one contact leg extends for each pin 11 of the assembly and the extending contact legs are staggered for engagement within staggered contact openings within the receiving printed circuit board.

The contact pins 11, as shown most clearly by FIG. 4, are formed as a continuous pin strip of a suitable conductive metal which is strong and flexible, such as phosphor bronze. The arm portions 22 and 23, or at least the contact areas 22*a* and 23*a* thereof, respectively, preferably are plated with gold over nickel for improved conduction purposes, corrosion resistance, and maximum durability, and the contact legs 11*a* and 11*b* preferably are plated with tin lead over nickel for improved contact purposes. One contact arm 23 extends at an angle from a base portion of the pin 11 in an area overlying the forward leg 11*a*, and is substantially straight in the angular direction of attachment of the circuit card and terminates in a first contact end 23*a* and the other contact arm 22 is generally C-shaped and extends vertically from said base portion above the rear leg 11*b*, and has a bottom, somewhat horizontal portion 22*b* which extends away from said rear leg 11*b* in a direction substantially perpendicular thereto, an upward bend portion 22*c*, and a top, somewhat horizontal portion 22*d* which extends back beyond said rear leg 11*b* to a position spaced above the forward leg 11*a*, and terminates in said second contact end 22*a*. While the contact legs 11*a* and 11*b* are freely received within the leg openings 24*a* and 24*b*, the contact pins 11 are provided with opposed projection barbs 25 and 26 which extend outwardly from the upper portions of the legs 11*a* and 11*b*, respectively and dig into and frictionally-engage the portions of the housing 10 adjacent the leg openings 24*a* and 24*b* when each of the contact pins 11 is forced down into fully-seated position within its slot 12. Such frictional engagement locks each pin 11 within its slot 12 against relative movement or withdrawal under the effects of use.

Insertion and locking of a printed circuit card 16 within the assembly 13 is accomplished by freely inserting the contact edge of the card 16 within the elongate slot 14 and then pivoting the card down over the bevelled opposed surfaces of the opposed flexible housing fingers 10*a* and 10*b* to flex and spread the fingers and permit the printed circuit card 16 to pass therebetween into engagement with inclined housing extensions 10*c* and 10*d* carrying alignment posts 10*e* and 10*f* respectively, which are received within slots on opposite side edges of the printed circuit card 16. When the card 16 is fully seated the opposed housing fingers 10*a* and 10*b* snap back past the side edges of the card 16 to overlie the top surface of the card, adjacent each end thereof, to lock it in position 16*a*.

It will be understood from the foregoing that the connector assembly 13 of FIGS. 1 to 5 provides a low profile microedge connector for thin printed circuit cards, which connector has a longitudinal narrow insertion gap comprising the distance between the opposed contact areas of an array of spaced contact pins. The gap permits the insertion of the edge of a circuit card with zero insertion force, and as the card pivoted towards inclined seated position an elevated engagement force is generated by the lever forces developed by the card 16 engaging upper contact arm areas 22*a* and the lower or forward contact arm areas 23*a*, causing flexing which provides a firm electrical interconnection between the contact pads of the card 16 and the contact pins 11 of the assembly 13, and a firm attachment which resists relative movement between the card and the assembly other than the pivot movement permitted by the flexible contact arms 22 and 23 until the card snaps into locked position. Thus, the present structure automatically aligns the card during insertion and locks the card in place by overlay of the fingers 10*a* and 10*b* rather than by reliance upon edge engagement which is weak and can cause bowing, as in prior known assemblies.

It will also be seen from FIG. 4 of the drawings that the flexible arms 22 and 23 of the contact pins 11 are each closely spaced from the floor of the slot 12 in the directions in which they are flexed apart from each other during use. Thus, the housing 10 cooperates with the flexing of the arms 22 and 23 to provide stop members which can contact the flexed arms 22 and 23 and limit the extent to which they can move. This prevents overstressing of the flexible arms and can also serve to increase the engagement force between the contact pins and the circuit card during the pivot-attachment of the card, thereby causing the pins to bite into the contact pads of the circuit card.

Figure 5:
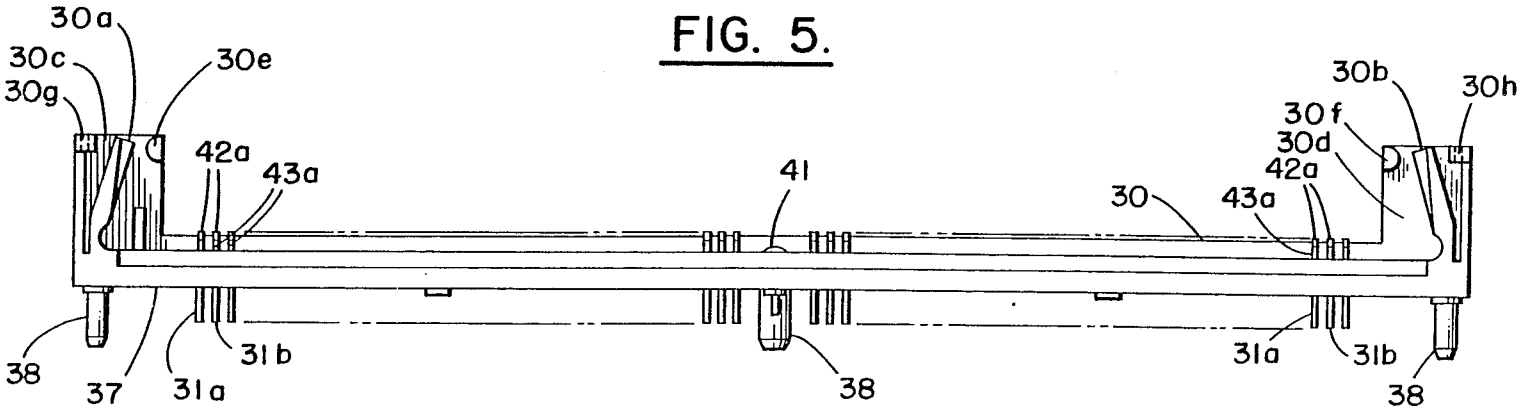
FIG. 5 is a side view of a portion of a vertical socket housing according to another embodiment of the present invention.
Figure 6:
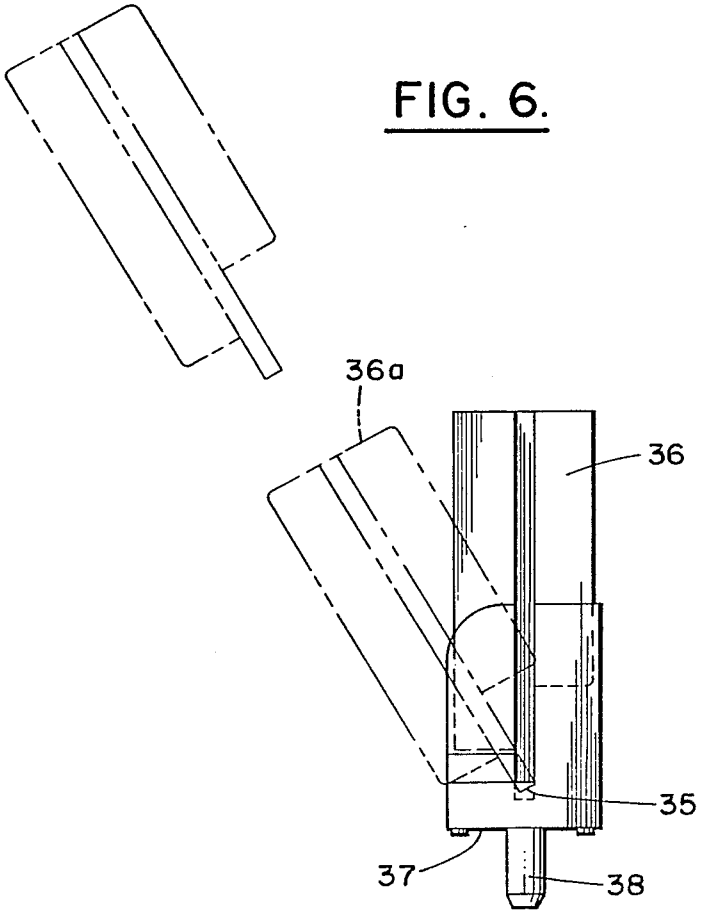
FIG. 6 is an end view of the vertical socket housing of FIG. 6, illustrating the insertion and connected positions of a printed circuit card by means of broken lines.

The embodiment of FIGS. 5 to 8 of the drawings comprises a vertical socket housing 30 and flat contact pins 31 designed to be frictionally-engaged within each of the plurality of parallel pin slots 32 thereof, to provide a multipin connector assembly 33 having an elongate longitudinal slot 34 for receiving the thin edge 35 of a card such as a dual-sided printed circuit card 36, for pivot attachment in vertical position as shown in FIG. 6.

Referring to FIG. 5, the vertical socket housing 30 thereof is an elongate plastic body molded from a high dielectric, strong, heat-resistant plastic molding composition, so as to have a standoff undersurface 37 provided with three alignment mounting posts 38, one adjacent each end and one in the center, which are positioned for engagement within holes in a master printed circuit board, not shown, to receive and support the vertical pin connector assembly 33.

The housing 30 has an upper surface 39 provided with an elongate longitudinal recess or slot 34 having a polarizing rib 40 adjacent one end thereof and a central rounded alignment stud 41 which mates with a recess (not shown) in the center of the edge 35 of the printed circuit card 36 to control the insertion and seating position of the card. The upper surface 39 of the housing 30 is also provided with a plurality of parallel contact pin-receiving slots 32 which extend through and perpendicular to the longitudinal recess or card-receiving slot 34. The pin slots 32 are clustered in two groups, one group at each side of the central alignment stud 41, the slots 32 in each group being uniformly spaced from each other, center-to-center, by a predetermined distance such as 0.05 inch, and each slot 32 having a uniform predetermined width, such as 0.015 inch, to receive a contact pin 31 of predetermined thickness, such as 0.0126 inch, therewithin, each slot 32 providing a walled recess which receives a contact pin 31 in a manner which permits the pin to move and flex freely within its own plane but which confines and insulates the pin against movement in the direction of adjacent contact pins 32.

Figure 8:
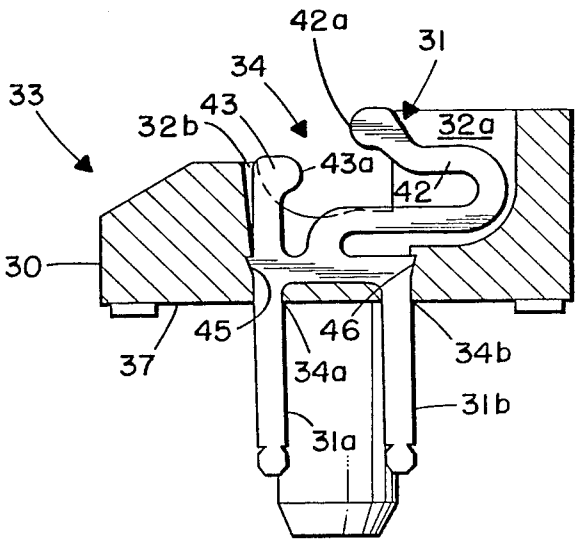
FIG. 8 is a view taken along the line 9—9 of FIG. 8, illustrating the position of a vertical contact pin within one of the pin slots thereof.

As shown more clearly in FIG. 8, the pin-receiving slots 32 confine a substantial portion of the contact pins 31, including the upper horizontal-extending portion 42*a* of flexible arm 42 which is confined within a deep portion 32*a* of the slots 32, and the lower, somewhat-vertical flexible arm 43, which is confined within a more shallow portion 32*b* of the slots 32. The housing undersurface 37 is also provided with a plurality of spaced pairs of contact leg openings 34*a* and 34*b*, one pair located within each of the contact slots 32 and of such size and location to receive the contact legs 31*a* and 31*b* of a contact pin 31 seated within each of the slots 32. Alternate contact legs 31*a* and 31*b* of adjacent contact pins 31 are cut away just below the floor 37 of the housing 30 so that only one contact leg extends for each pin 31 of the assembly and the extending contact legs are staggered for engagement within staggered contact openings within the receiving printed circuit board.

The contact pins 31, as shown most clearly by FIG. 8, are formed as a continuous pin strip of a suitable conductive metal which is strong and flexible, such as phosphor bronze. The arm portions 42 and 43, or at least the contact areas 42*a* and 43*a* thereof, respectively, preferably are plated with gold over nickel for improved conduction purposes, corrosion resistance, and maximum durability, and the contact legs 31*a* and 31*b* preferably are plated with tin lead over nickel for improved contact purposes. While the contact legs 31*a* and 31*b* are freely received with the leg openings 34*a* and 34*b*, the base portion or body of the contact pins 31 is provided with opposed projection barbs 45 and 46 which extend outwardly from the base, adjacent the upper portions of the legs 31*a* and 31*b*, respectively and dig into and frictionally-engage the portions of the housing 30 adjacent the leg openings 34*a* and 34*b* when each of the contact pins 31 is forced down into fully-seated position within its slot 32. Such frictional engagement locks each pin 31 within its lot against relative movement and withdrawal under the effects of use.

Another effect of such locking engagement, according to the embodiment of FIGS. 5 to 8, is a locking of each contact pin within its slot 32 in such a manner that the flexible pin arms 42 and 43 are closely-spaced away from adjacent seat portions of the slot portions 32*a* and 32*b*, as illustrated by FIG. 8. This spacing permits the arms 42 and 43 to be flexed apart during the step of pivot attachment of the printed circuit card, illustrated by FIG. 6, and to be supported by the housing in flexed position to prevent overstress and resultant distortion and possible breakage. Moreover, the spring arm 42 has a loop or C-shape so as to distribute the flexing stress of the arm 42. As illustrated by FIG. 8, the arm 43 extends vertically from the base portion, over leg 31*a*, in the direction of attachment of the circuit card, i.e., vertically, and is spaced somewhat from the base or floor of the housing slot 32*b* to permit limited flexing. The companion C-shaped arm 42 also extends vertically from the base a short distance but then diverts as a horizontal portion in a direction perpendicular to that of the legs, beyond rear leg 31*b*, and into an upward curve portion and a top somewhat horizontal portion which extends back over the rear leg 31*b* and terminates in the contact end 42*a*. Thus, when the edge 35 of a printed circuit card 36 is freely inserted at an angle into the longitudinal slot 34 and is pivoted to vertical position, as shown by FIG. 6, the contact pads of the card 36 engage the contact faces 42*a* and 43*a* and separate the contact arms 42 and 33 which exert an engagement force. The vertical arm 43 flexes within slot 32*b* and is protected against excessive flexing by the base of the slot which it can engage during excessive flexing.

Locking of the vertical printed circuit card 36 is accomplished by pivoting the inserted card 36 up against the beveled surfaces of the opposed flexible housing fingers 30*a* and 30*b* to spread the fingers and permit the printed circuit card 36 to pass therebetween into engagement with vertical housing extensions 30c and 30*d* carrying alignment posts 30*e* and 30*f* respectively which are received within slots (not shown) on opposite side edges of the printed circuit card 36. When the card 36 is fully seated the opposed housing fingers 30*a* and 30*b* snap back over the card surface inwardly of the side edges of the card 36 to overlie the card and lock it in position 36.

It will be understood from the foregoing that the connector assembly 33 of FIGS. 5 to 8 provides a low profile microedge connector for thin printed circuit cards, which connector has a longitudinal narrow insertion gap comprising the distance between the opposed contact areas 42*a* and 43*a* of an array of spaced contact pins 31. The gap permits the insertion of the edge of a circuit card with zero insertion force, and as the card is pivoted towards vertical seated position a strong engagement force is generated by the flexing of arms 42 and 43, within slot areas 32*a* and 32*b*, which provides a strong electrical interconnection between the contact pads of the card 36 and the contact areas 42*a* and 43*a* of the pins 31 of the assembly 33, and a firm attachment which resists relative movement between the card and the assembly other than the pivot movement provided by the flexibility of the arms 42 and 43 until the card snaps into locked position.

The housing 30 cooperates with the flexing of the arms 42 and 43 to provide stop members which can contact the flexed arms 42 and 43 and limit the extent to which they can move. This can prevent overstressing of the flexible arms and can also serve to increase the engagement force between the contact pins and the circuit card during the pivot-attachment of the card, thereby causing the pins to bite into the contact pads of the circuit card 36.

It is to be understood that the above described embodiments of the invention are illustrative only and that modifications throughout may occur to those skilled in the art. Accordingly, this invention is not to be regarded as limited to the embodiments disclosed herein, but is to be limited as defined by the appended claims.

What is claimed is:

1. A multiple contact assembly for receiving the contact edge of a thin printed circuit card for pivot attachment therewithin, said assembly comprising an elongate dielectric housing having an elongate slot designed to receive the contact edge of a thin printed circuit card for pivot movement therewithin, a plurality of uniformly spaced narrow contact pin slots extending through said elongate slot, each said pin slot having a pair of spaced openings in the floor thereof, a plurality of thin contact members, one engaged within each of said pin slots and having a spaced pair of contact legs extending through the openings in the floor thereof for electrical engagement of at least one of said legs outside of said housing, each said contact member comprising a flat metallic body having a base portion form which said contact legs extend, said base portion extending through said elongate slot and having a pair of opposed upright flexible spaced contact arms individually extending therefrom, one at each side of said elongate slot and each having a contact end which extends over said elongate slot and is designed for electrical engagement with an electrical contact present on one side of a printed circuit card secured within said elongate slot, one of said contact arms extending from said base portion, in an area overlying one of said legs, and being substantially straight in the direction of attachment of the circuit card and terminating in a first contact end, and the other of said contact arms extending from said base portion above the other of said legs, and having a bottom portion which extends away from said legs in a direction substantially perpendicular to the direction of said legs, an upward end portion, and a top portion which extends back beyond said other leg and terminates in a second contact end, said contact ends being spaced by a distance slightly greater than the thickness of the contact edge of said printed circuit card, the base portion of each said contact member being provided with means for locking each said contact member in seated position within its pin slot so that each of said flexible contact arms is supported within its pin slot for flexing movement to electrically engage a said printed circuit card during the pivot attachment thereof, said means for locking comprising a spaced pair of barbs extending form spaced areas of the base portion of each contact member, which barbs penetrate said housing to prevent withdrawal of the contact members from seated position.

2. A multiple contact assembly according to claim 1 in which housing comprises a spaced pair of flexible members, one at each end of said elongate slot, each said finger member having a flat undersurface designed to overlie a portion of the top surface of an attached printed circuit card, inwardly of the end edges thereof.

3. A multiple contact assembly according to claim 2 in which each flexible finger member has a downwardly and inwardly tapered surface which is designed to be engaged by an edge surface of a printed circuit card during the pivot attachment thereof, such engagement causing said finger members to be flexed apart until said end edges pass under said finger members to permit aid finger members to snap out of engagement with said end edges and over said card.

4. A flexible contact member designed to be supported within a dielectric housing for flexible engagement with a printed circuit card having electrical contacts on opposite sides thereof, said contact member comprising a thin, flat metallic body having a base portion, a spaced pair of contact legs extending downwardly form said base portion for passage through openings in the floor of a dielectric housing, a pair of opposed flexible contact arms extending upwardly from said base portion and terminating in contact ends forming a flexible gap therebetween adapted to receive and engage the contact edge of a thin printed circuit card inserted and pivoted therebetween, one of said contact arms extending from said base portion, in an area overlying one of said legs, and being substantially straight in the direction of attachment of the circuit card and terminating in a first contact end, and the other of said contact arms extending from said base portion above the other of said legs, and having a bottom portion which extends away from said legs in a direction substantially perpendicular to the direction of said legs, an upward bend portion, and a top portion which extends back beyond said other leg and terminates in a second contact end, said contact member also comprising a spaced pair of barbs, one projecting from each end of said hose portion for penetrating locking engagement with a said dielectric housing when the contact member is forced into seated position therewithin.

* * * * *

UNITED STATES PATENT AND TRADEMARK OFFICE

CERTIFICATE OF CORRECTION

PATENT NO. : 4,826,446

DATED : May 2, 1989

INVENTOR(S) : Eric Juntwait

It is certified that error appears in the above—identified patent and that said Letters Patent is hereby corrected as shown below:

Col. 8, line 27 (Claim 2, line 2), after "flexible" insert --finger--;

Col. 8, line 46 (Claim 4, line 7), replace "form" with --from--;

Col. 8, line 65 (Claim 4, line 26), replace "hose" with --base--.

Signed and Sealed this

Second Day of January, 1990

*Attest:*

JEFFREY M. SAMUELS

*Attesting Officer*

*Acting Commissioner of Patents and Trademarks*